US009702227B2

(12) United States Patent
Carminati et al.

(10) Patent No.: US 9,702,227 B2
(45) Date of Patent: Jul. 11, 2017

(54) PROCESS FOR TRANSPORTING EXTRACTION FLUIDS SUCH AS FOR EXAMPLE NATURAL GAS, OIL OR WATER, AND UNDERWATER VEHICLE FOR EFFECTING SAID PROCESS

(71) Applicant: ENI S.P.A., Rome (IT)

(72) Inventors: Stefano Carminati, Monza (IT); Alessio Nista, Spinea (IT)

(73) Assignee: ENI S.p.A., Rome (IT)

( * ) Notice: Subject to any disclaimer, the term of this patent is extended or adjusted under 35 U.S.C. 154(b) by 0 days.

(21) Appl. No.: 15/030,272

(22) PCT Filed: Oct. 20, 2014

(86) PCT No.: PCT/IB2014/065467

§ 371 (c)(1),
(2) Date: Apr. 18, 2016

(87) PCT Pub. No.: WO2015/059619

PCT Pub. Date: Apr. 30, 2015

(65) Prior Publication Data

US 2016/0251944 A1 Sep. 1, 2016

(30) Foreign Application Priority Data

Oct. 21, 2013 (IT) ..... MI2013A1753

(51) Int. Cl.
*E21B 43/01* (2006.01)
*E21B 43/36* (2006.01)
(Continued)

(52) U.S. Cl.
CPC ..... *E21B 43/01* (2013.01); *B63G 8/001* (2013.01); *B63G 8/42* (2013.01); *E21B 43/36* (2013.01); *E21B 43/40* (2013.01)

(58) Field of Classification Search
CPC ..... B63G 8/001; E21B 43/01; E21B 43/36
(Continued)

(56) References Cited

U.S. PATENT DOCUMENTS 2,990,796 A * 7/1961 Cole ..... B65D 88/78 114/125
5,356,321 A * 10/1994 Boatman ..... B63B 21/508 114/230.12

(Continued)

FOREIGN PATENT DOCUMENTS

DE 2 135 826 A1 3/1972
DE 2135826 A1 * 3/1972 ..... B63B 35/12

OTHER PUBLICATIONS

International Search Report issued Feb. 18, 2015 in PCT/IB2014/065467.

*Primary Examiner* — Lars A Olson
(74) *Attorney, Agent, or Firm* — Oblon, McClelland, Maier & Neustadt, L.L.P.

(57) ABSTRACT

The process according to the invention, for transporting extraction fluids, such as, for example, natural gas, oil or water, comprises the following operations: (a) hydraulically connecting the underwater vehicle (1) to the head of an extraction well; (b) transferring and storing the extracted fluid, such as, for example, natural gas, oil or water, on the vehicle (1), subjecting said fluid to one or more of the following processes through plants installed onboard the same vehicle (1): b.1) mechanical, electrical or chemical separation; b.2) separation of the gases or more volatile fractions of the extracted fluid; b.3) separation of predetermined phases or substances from the rest of the extracted fluid; b.4) extraction and elimination of acid gases, such as, for example, carbon dioxide or hydrogen sulphide; b.5) re-injection into geological formations; (c) transporting the
(Continued)

extracted fluid(s) subjected to one or more of the processes b.1-b.5) causing the underwater vehicle to advance in immersion.

12 Claims, 8 Drawing Sheets

(51) Int. Cl.
*B63G 8/42* (2006.01)
*B63G 8/00* (2006.01)
*E21B 43/40* (2006.01)

(58) Field of Classification Search
USPC ..... 114/321
See application file for complete search history.

(56) References Cited

U.S. PATENT DOCUMENTS

| | | | | |
|---|---|---|---|---|
| 7,726,911 | B1 * | 6/2010 | Dempster | B63B 35/44<br>114/256 |
| 8,292,546 | B2 * | 10/2012 | Wu | B65D 88/78<br>405/210 |
| 9,003,994 | B2 * | 4/2015 | Leverette | B63B 21/00<br>114/199 |
| 2016/0251944 | A1 * | 9/2016 | Carminati | E21B 43/36 |

* cited by examiner

PROCESS FOR TRANSPORTING EXTRACTION FLUIDS SUCH AS FOR EXAMPLE NATURAL GAS, OIL OR WATER, AND UNDERWATER VEHICLE FOR EFFECTING SAID PROCESS

FIELD OF THE INVENTION

The present invention relates to a process for transporting extraction fluids such as, for example, natural gas, oil or water, and an underwater vehicle for effecting this process.

STATE OF THE ART

Tanks designated for remaining completely submerged while they are being towed by a vessel for transporting natural gas or oil, as an alternative to fixed pipes lying on seabeds or ocean-beds or to tankers, are known. The document U.S. Pat. No. 3,975,167 describes an underwater tank which allows natural gas to be transported in the form of hydrates, or clathrates. The transformation of natural gas to hydrates and the reverse transformation when the tank is discharged, increase the transportation costs; furthermore, hydrates have a much greater specific weight with respect to compressed or liquefied natural gas, and in any case greater than oil, and this makes the floating of the tank more difficult; it seems that no-one has so far succeeded in developing an economically convenient procedure for storing and transporting gas through hydrates.

It would be desirable to be able to avail of transporting systems alternative to the known systems, to be able to exploit reservoirs with wellheads situated on seabeds or ocean-beds at great depths, or underwater wells having a capacity which is not sufficiently high to make the laying of oil-pipelines or gas-pipelines fixed on seabeds, the installation of a fixed extraction platform or the permanent immobilization of extraction and pretreatment vessels such as, for example, so-called floating production, storage and offloading units (FPSO), worthwhile. Using, for this purpose, tanks which are completely submerged for transporting natural gas or oil from the well to the oil-pipeline, gas-pipeline or closest treatment plant on the mainland, would be desirable for various reasons, for example the lower risk of collision with other vessels, a greater intrinsic safety against fires, explosions and leakages of gas or other fluids transported, a greater intrinsic safety for the crew, which would operate at a greater distance from the material transported, which is often flammable. The authors of the present invention, however, believe that the known underwater tanks previously described do not allow a sufficiently economical transportation.

Furthermore, obtaining the hydrates envisaged by the transportation system described in U.S. Pat. No. 3,975,167 requires, in practice, that the natural gas to be transported be previously cleansed and purified of undesired substances, for example nitrogen, $CO_2$, hydrogen sulphide, butane and hydrocarbons heavier than the latter; the transportation system described in U.S. Pat. No. 3,975,167 cannot therefore be used for economically exploiting oil fields situated under relatively deep seabeds, for example at depths greater than 500-600 meters, as it is not able to load natural gas or oil directly extracted from an underwater wellhead.

An objective of the present invention is to overcome the drawbacks of the state of the art mentioned above, and in particular, to provide a system for transporting fluids such as, for example, natural gas, oil or water which is more efficient and less expensive than the known underwater tanks.

SUMMARY OF THE INVENTION

This objective is achieved, in a first aspect of the present invention, with a procedure for transporting extraction fluids having the characteristics according to claim 1.

In a second aspect of the invention, this objective is achieved with an underwater vehicle having the characteristics according to claim 7.

Further characteristics of the device are object of the dependent claims.

The advantages that can be obtained with the present invention will appear more evident to a skilled person in the field from the following detailed description of a particular non-limiting embodiment example, illustrated with reference to the following schematic figures.

LIST OF FIGURES

DETAILED DESCRIPTION

Figure 1:
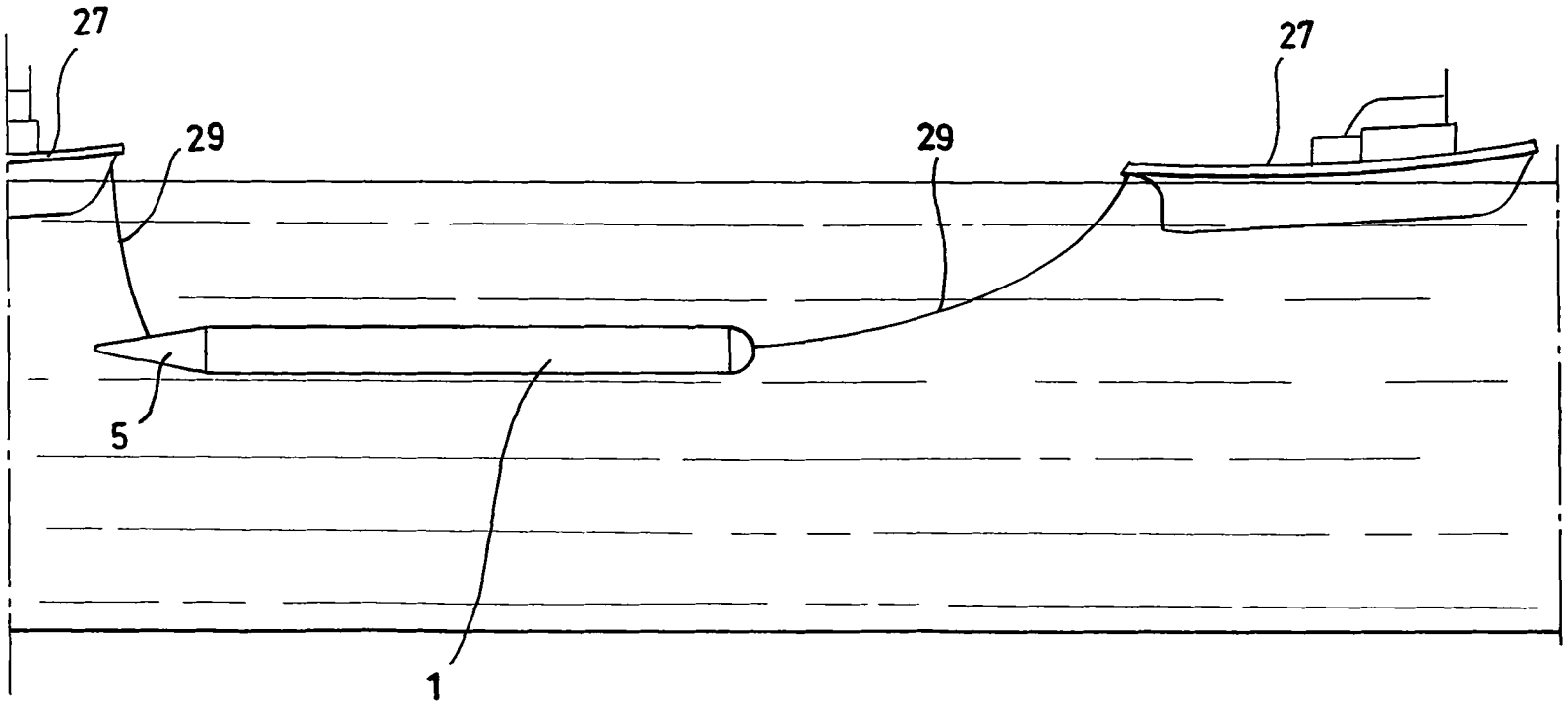
FIG. 1 shows a first side view of an underwater vehicle towed by two tugboats during normal navigation, according to a particular embodiment of the invention.

FIGS. 1 to 8 relate to a process for transporting fluids such as, for example, natural gas, oil or water, and an underwater vehicle for effecting this process, according to a particular embodiment of the present invention. The underwater vehicle, indicated with the overall reference number 1, is particularly suitable for exploiting wells from which prevalently gas is extracted, and together with this, a possible marginal fraction of oil and/or water. The vehicle 1 as a whole has an elongated form, advantageously like a torpedo.

The underwater vehicle 1 preferably has a hydrodynamic bow 3, i.e. for example, a hemispherical, ogival, ovoid, conical or in any case tapered cap, and a drop-shaped or in any case tapered tail 5, so as to reduce fluid-dynamic resistances to underwater advancement; it can have sides 7 having transversal sections with a substantially constant form and dimensions; the sides 7 can therefore be substantially cylindrical or prismatic.

Preferably the transversal sections of the vehicle 1, or at least its sides, have an external perimeter with a substantially elliptical form (FIGS. 2, 5, 6); the ratio between the minor and major semi-axes of said ellipsoidal perimeter preferably ranges from 0.85 to 0.5, and more preferably from 0.7-0.8; these ratios between the semi-axes have proved to be optimum for conferring a good hydrostatic stability both when immersed and during the floating of the vehicle 1.

The underwater vehicle 1 preferably comprises one or more containment tubes 9 designed for containing the natural gas, oil, water or other fluid to be transported. The one or more containment tubes 9 advantageously form a bundle which prevalently extends longitudinally with respect to the underwater vehicle 1.

The one or more containment tubes 9 advantageously form a substantially straight bundle, i.e. with a substantially straight axis.

The vehicle 1 preferably also comprises a main structure 11 designed to withstand loads, for example by bending or compression, the vehicle 1 itself and comprising a plurality of structural tubes 13 which substantially extend longitudinally with respect to the underwater vehicle 1.

Figure 3:
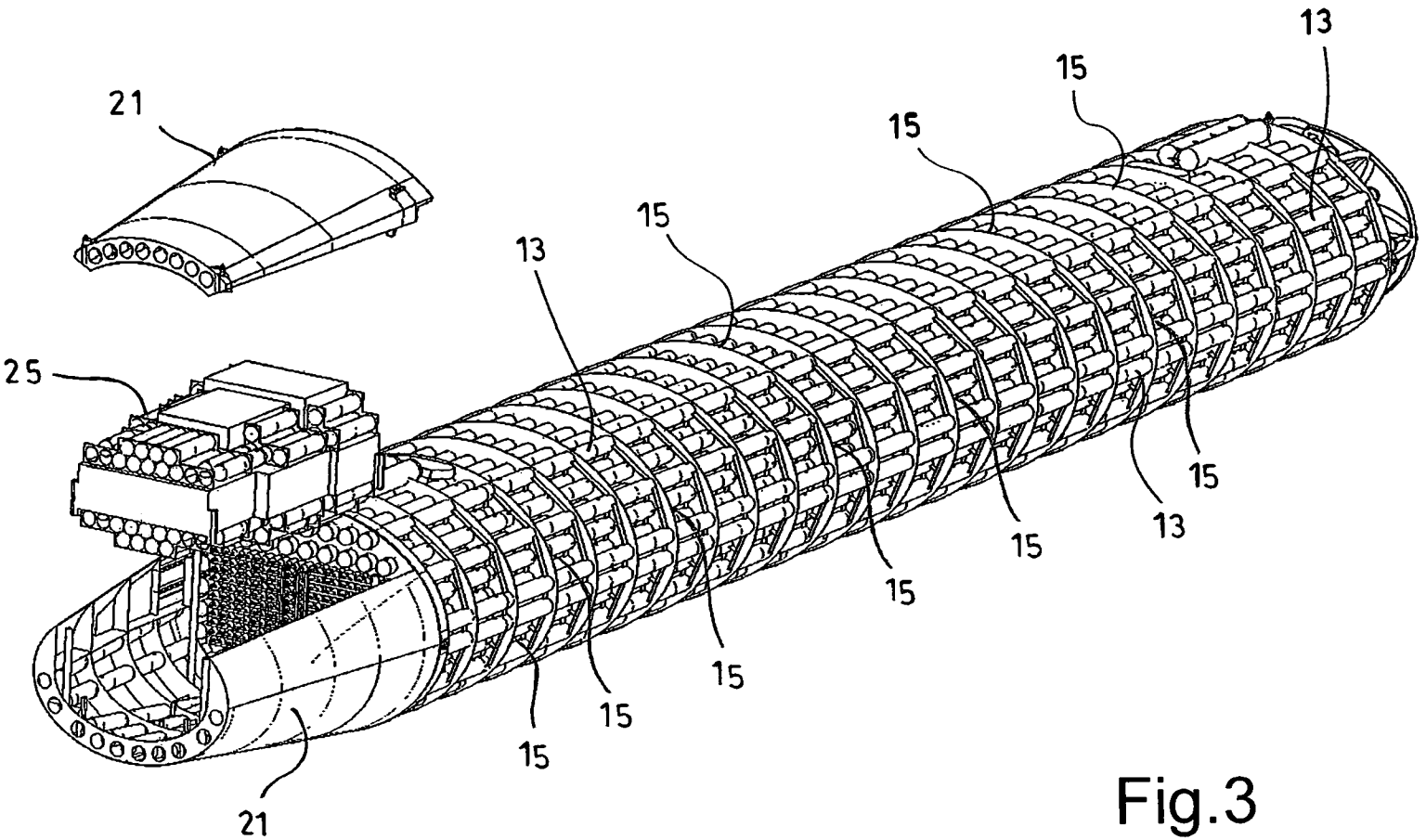
FIG. 3 shows a second partially exploded perspective view of the underwater vehicle of FIG. 1, without the covering shell and with the removable module extracted from the body of the underwater vehicle.
Figure 4:
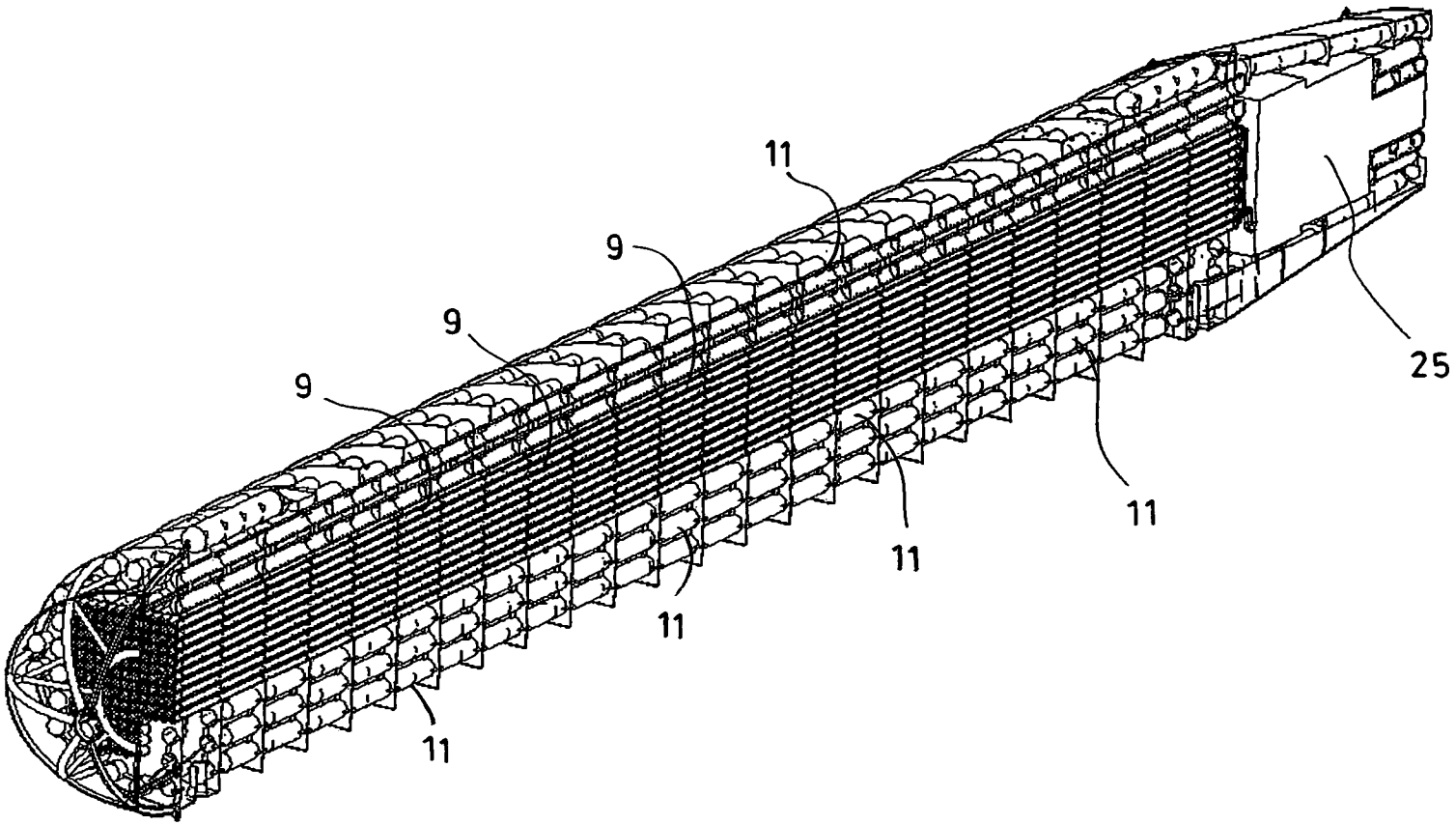
FIG. 4 shows a second perspective view of the underwater vehicle of FIG. 1, without the covering shell and partially sectioned according to a longitudinal and vertical plane.

As in the embodiment illustrated, the containment tubes 9 and/or the structural tubes 13 preferably extend for at least half of the overall length L of the underwater vehicle 1, more preferably for at least three-quarters of the length L (FIGS. 3, 4).

The main structure 11 preferably also comprises a plurality of transverse frames 15 positioned substantially transversal to the containment tubes 9 and to structural tubes 13, supporting them and holding them in precise positions in the space.

Each transverse frame 15 can comprise, for example, a main plate 150 in which a plurality of first holes 152 and second holes 154 is formed. Structural tubes 13 pass through the first holes 152 and containment tubes 9 pass through the second holes 154. The references 15' of FIG. 6 indicate the transverse frames of the tail 5.

Figure 5:
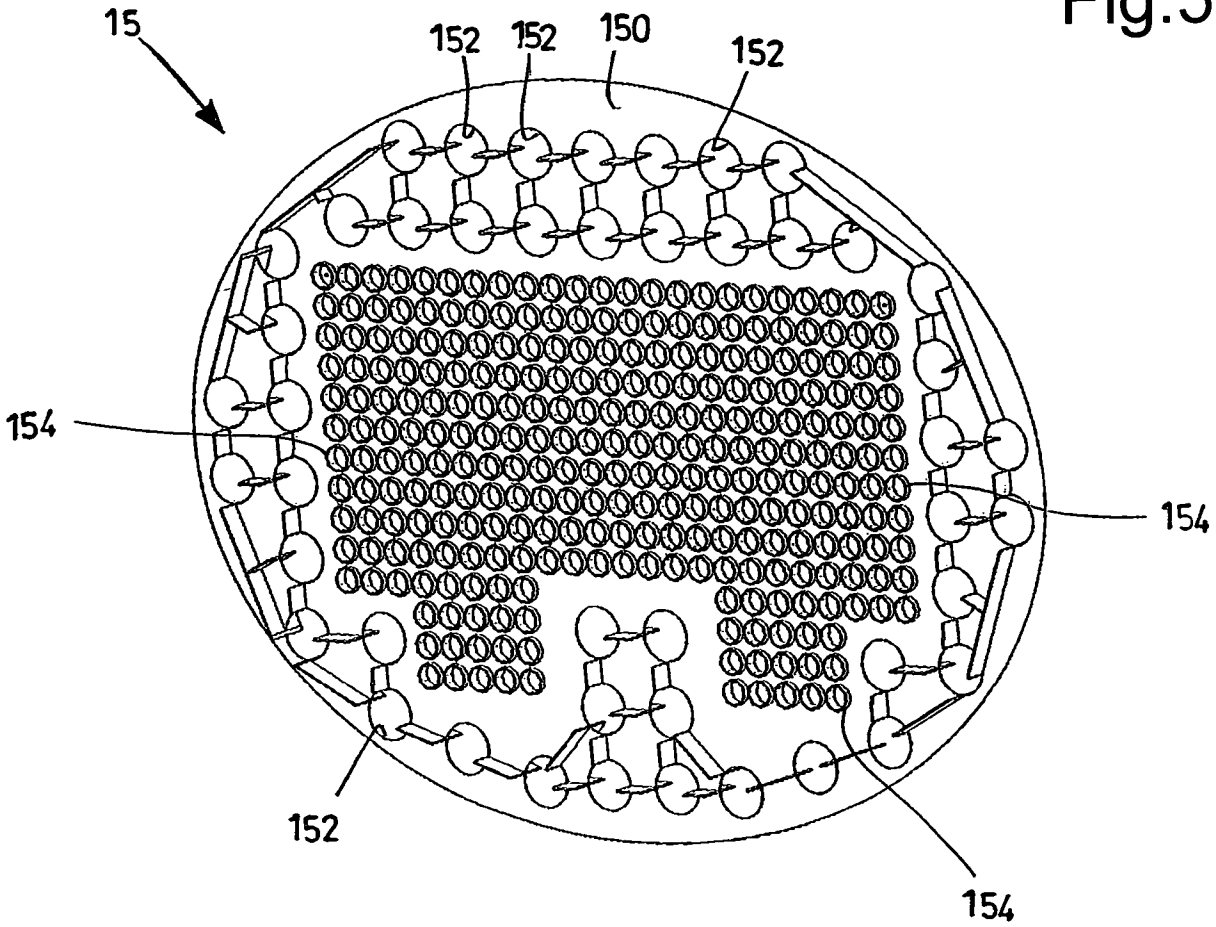
FIG. 5 shows the perspective view of a transverse frame of the underwater vehicle of FIG. 1.
Figure 6:
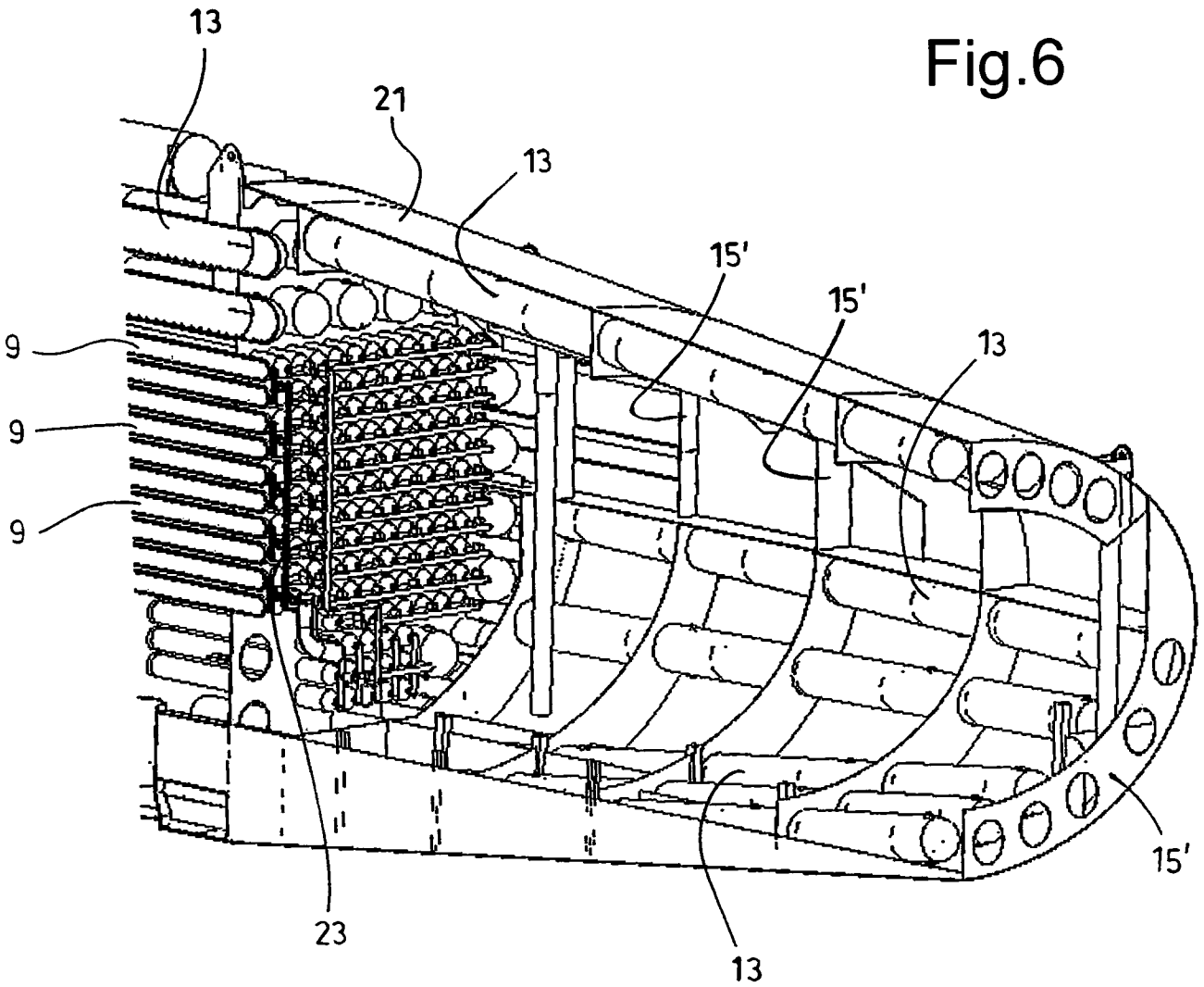
FIG. 6 shows a perspective view with a detail of the stern of the underwater vehicle of FIG. 1, without the covering shell.

As shown in FIGS. 4, 5, at least part of the structural tubes 13 extends around the containment tubes 9, protecting them and separating them from the outside of the vehicle 1. The assembly of structural tubes more preferably extends around the assembly of containment tubes 9, surrounding and protecting the latter.

The containment tubes 9 are advantageously fixed, in a longitudinal direction, substantially in correspondence with a single transverse frame 15, or another transversal section, of the main structure 11, whereas they are free to slide longitudinally with respect to the other transverse frame, thus being free to compensate the variations in length due to the variations in temperature and pressure of the fluid to be transported contained therein. In this way, the containment tubes 9 do not exert structural functions and are only subjected to stress by the difference between their internal and external pressures. The structural tubes 13, on the other hand, can be fixed, for example welded, to all the transverse frames 15.

The containment tubes 9 can be advantageously obtained from ordinary tubes for underwater pipelines, in conformance for example with the standards API SPEC 5L, ISO3183 or DNV OS-F101. The containment tubes 9 can be designed, for example, for resisting at an internal pressure of 250 bar and an external pressure of 45 bar; in this case, the maximum operational depth of the vehicle 1 would be about 450 meters; the containment tubes 9 can, for example, have a nominal internal diameter within the range of 20-52 inches, and equal, for example, to about 36 inches. The functioning depth of 450 meters is optimum as the external water pressure is substantially counterbalanced in this respect by the pressure (preferably 45 bar) of the content of the tubes 9. Both the containment tubes 9 and the structural tubes 13 can, for example, be made of steel, another suitable metallic material, carbon fibres, fibreglass or another composite material.

Advantageously at least part, and preferably all, of the structural tubes 13 is designed for being reversibly filled and emptied with a suitable ballast material, such as for example, the same water in which the underwater vehicle 1 is immersed, so as to control and vary the floating or immersion depth of the underwater vehicle 1.

Figure 2:
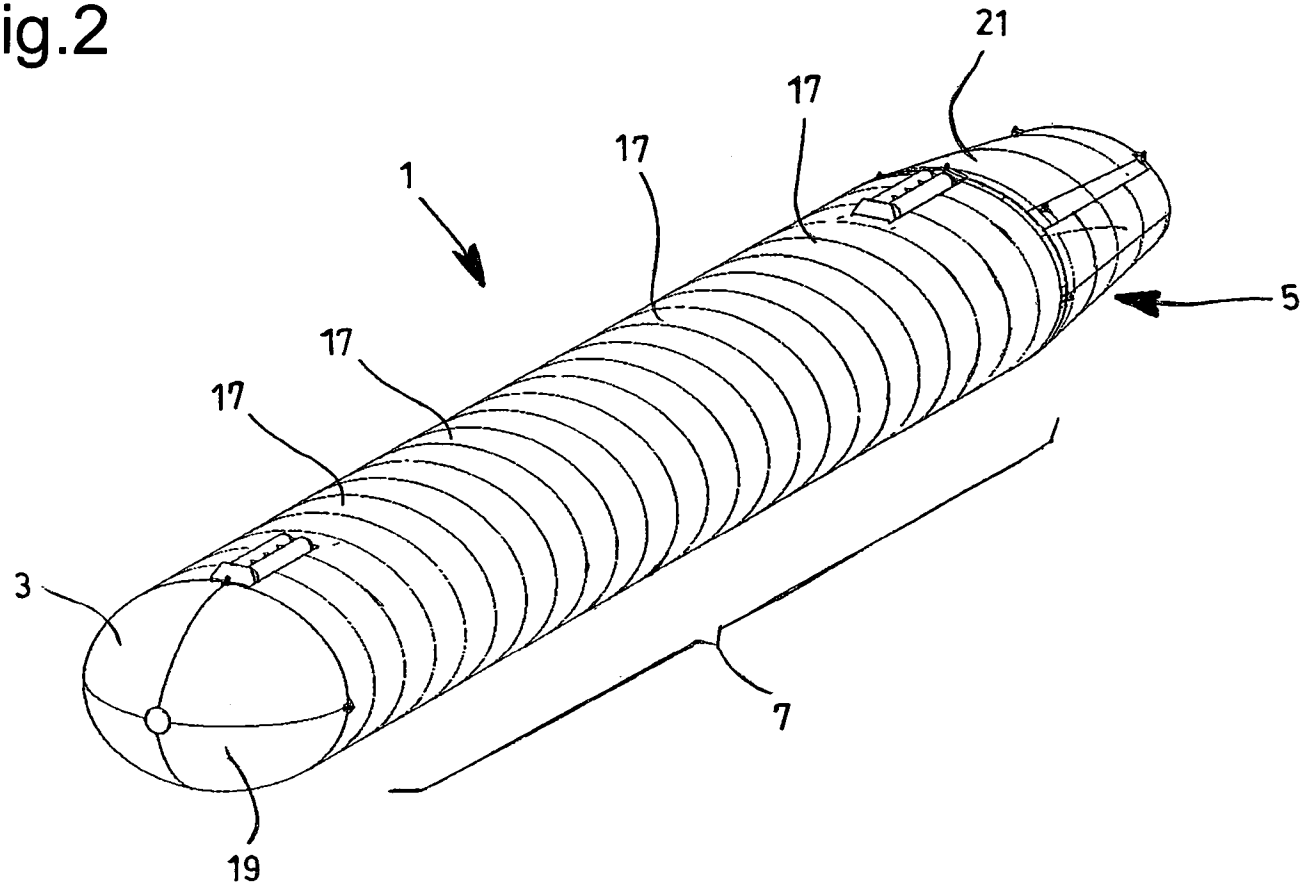
FIG. 2 shows a first perspective view of the underwater vehicle of FIG. 1.

In order to reduce the fluid-dynamic resistance, the main structure 11 is covered by a covering shell composed, for example, of a plurality of panels 17, 19, 21, made of fibreglass, another suitable synthetic resin or metal sheet. The covering shell gives the underwater vehicle 1 a more hydrodynamic and smooth shape (FIG. 2). In order to simplify the construction, the covering shell is not watertight, so that the same pressure present outside of it, can also be present naturally in its interior.

The various containment tubes 9 are preferably hydraulically connected with each other by means of one or more collectors 23 (FIG. 6) and can be isolated from each other by means of suitable valves, so as to allow the various tubes 9 to be emptied or filled, either altogether or selectively.

According to an aspect of the invention, the underwater vehicle 1 is provided with one or more of the following plants:

a) a mechanical, electrical and/or chemical separation plant, for separating the possible solid or liquid phase, for example water, salts or liquid hydrocarbons, from the gas with which the containment tubes 9 are filled;

b) a plant for stabilizing the stored oil and separating its more volatile fractions and possible gases dissolved therein;

c) a plant for separating the acid gases;

d) a plant for separating predetermined phases or substances from the gas or other fluid to be transported;

e) a plant for compressing the gases to be stored in the containment tubes 9 and/or air for feeding a circuit of compressed air destined for activating several motors and devices onboard;

f) emergency plants;

g) plants for telemetry, localization and control of the vehicle 1 and its containers;

h) a plant for the generation of power for possibly feeding other plants present on the vehicle.

The separation plant of acid gases can separate, for example, $CO_2$ or hydrogen sulphide through cycles with amines, resorting, for example, to membrane separators, cryogenic cycles, PSA (Pressure Swing Adsorber) membranes, molecular sieves and/or possibly effecting operations such as, for example, adsorbing and separating the sweetened gas, purifying the amine(s), separating the elemental sulfur, re-injecting the $CO_2$, hydrogen sulphide or other acid gases into the reservoir.

The elemental sulfur, or other undesired impurities and substances separated from the gas or oil, can be advantageously preserved and transported on the same vehicle 1 to be more easily disposed of or resold at destination.

Advantageously the plants a)-h) possibly present, or at least their motors, pumps and electric, electronic and hydraulic circuits for communication and power transmission are all grouped in a removable module 25 designed for being rapidly and easily removed from the rest of the vehicle 1 and re-inserted therein (FIG. 3). The fluid circuits onboard the removable module 25 are preferably provided with couplings and other rapid connection systems to the parts of the fluid and electric circuits or mechanical systems that remain permanently fixed on the rest of the vehicle. These couplings can, for example, be of the screw, bayonet or snap type. In this way, the mechanically or electrically more complex components and those subject to breakdowns and wear of the vehicle 1, can be rapidly removed from the latter to be subjected to programmed servicing and maintenance in specific workshops, whereas the rest of the vehicle 1 waits in a port or dock, or is ever better equipped with another removable module already serviced, and can continue to operate.

The hydraulic, electrical, chemical plants and various motors, pumps and drives onboard the vehicle 1, can be supplied with energy coming for example from the vessels 27 that tow or in any case guide the vehicle 1 itself. The electric or mechanical power supplied by the vessels 27 can be stored by the vehicle 1, for example by accumulating compressed air in suitable tanks onboard and/or in suitable electric accumulators. The vessels 27 preferably supply the vehicle 1, and more specifically its removable module 25, only when the latter is not in navigation and when it is anchored, for example, and connected to the wellhead from which it loads the fluid to be transported.

The underwater vehicle 1 can have an overall length L of several hundreds of meters, ranging, for example, from 250-350 meters or from 100-400 meters, and have, for example, elliptical transversal sections with a major semi-axis ranging from 35-45 meters and a minor semi-axis ranging from 25-35 meters. With these dimensions, the vehicle 1 can have a loading capacity of about 12 MSCM (millions of standard cubic meters), i.e. equivalent to that of CNG—Compressed Natural Gas—ships currently being designed.

The underwater vehicle 1 can be used, for example, as a shuttle for removing crude oil and/or natural gas directly from underwater wells and transporting it to a receiving station on the mainland, such as for example, a terminal of a gas pipeline, oil-pipeline or refinery. The separation plants of acid gases and more volatile fractions allow natural gas or oil to be loaded directly from the extraction well, and offloading of products already pretreated at destination.

The vehicle 1 can be without its own propulsion engines and be designed for being towed by one or more tugboats 27, preferably offshore tugboats, icebreakers, or other vessels, for example by means of chains hawsers 29. During towing, the vehicle 1 is preferably also guided by a second tug, or other vessel 27 by means of a chain or hawser 29 fixed in correspondence with or close to the stern 5 of the vehicle 1. The vehicle 1 can load the crude oil and/or natural gas to be transported directly from a submerged wellhead, removing it for example from wellheads embedded in the seabed ("glory holes") to protect them from the passage of icebergs, from a disconnectable turret, for example of the APL (Advanced Production Loading) type, or other underwater mooring buoy ("mooring buoy" or "spider buoy") 200 situated close to the seabed or at an intermediate depth, for example if the seabed F is lower than the maximum operational depth of the vehicle 1. Examples of submerged mooring buoys known per se, for exploiting oil fields, are described, for example, in the documents WO 87/05876 or U.S. Pat. No. 5,356,321. The extraction fluid is advantageously loaded onto the underwater vehicle 1, for example by means of a suitable pipeline 202, while the latter is immersed, preferably at a depth ranging from 20 to 100 meters, more preferably ranging from 40-70 meters, for example equal to about 50 meters.

Figure 8:
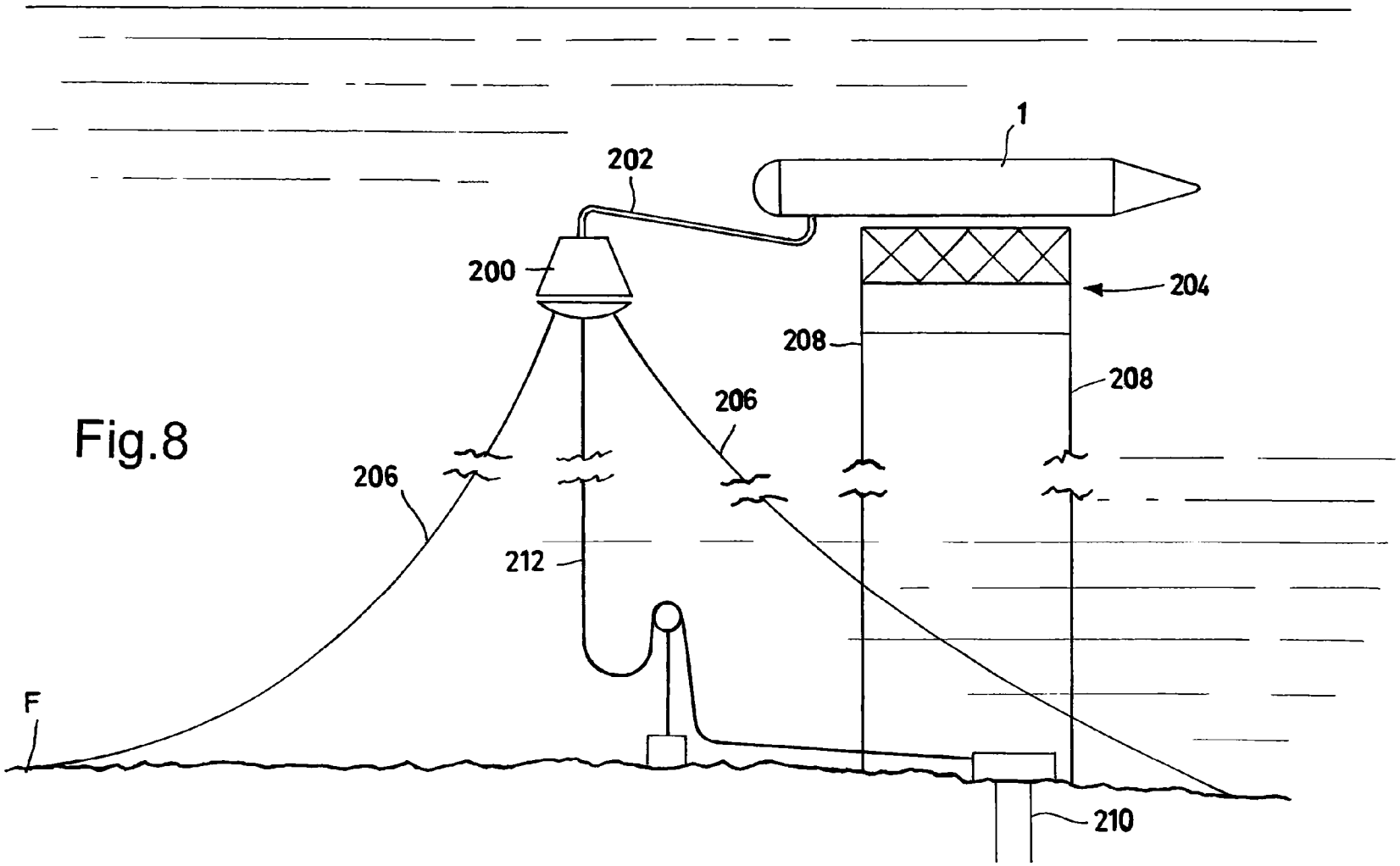
FIG. 8 shows a moment of the loading operations of the underwater vehicle of FIG. 1 with natural gas coming directly from a submerged wellhead.

During the loading operations, the vehicle 1 can rest on suitable bases, in turn resting on the seabed, remain hanging on the supporting buoy 31 described in more detail hereunder or be anchored to suitable tensioned turrets or fixed buoys 204 and in turn anchored onto the seabed (FIG. 8). The reference numbers 206, 208 indicate anchoring cables to the seabed. The natural gas, crude oil or other extraction fluid coming from the wellhead 210 reaches the mooring buoy 200 by means of the pipeline 212.

Resorting to fixed buoys is useful, for example, if the crude oil, natural gas or other fluid to be transported comes from a seabed situated at a greater depth than the maximum operational depth of the vehicle 1 itself.

The vehicle 1 can be anchored to the bases 202 by means of cables or chains. The fixing and releasing operations of the anchoring chains or cables, of the APL turret, sleeves or other pipelines for loading the fluid to be transported onto the vehicle 1 or unloading it therefrom can be effected, for example, by means of suitable ROVs. During navigation, the vehicle 1 is preferably towed, remaining completely submerged at such depths as to reduce risks of collision with vessels and other floating objects, for example at depths ranging from 20-100 meters, more preferably ranging from 40-80 meters, for example from 50 to 70 meters. Navigation in immersion at significant depths also reduces movement resistance due to waves and wind. Furthermore, towing the completely immersed vehicle 1 provides greater isolation for the crew from flammable or explosive loads and generally increases the intrinsic safety of the transportation.

During navigation at full load, the weather/sea conditions may become particularly prohibitive, making it necessary to abandon the system.

Figure 7:
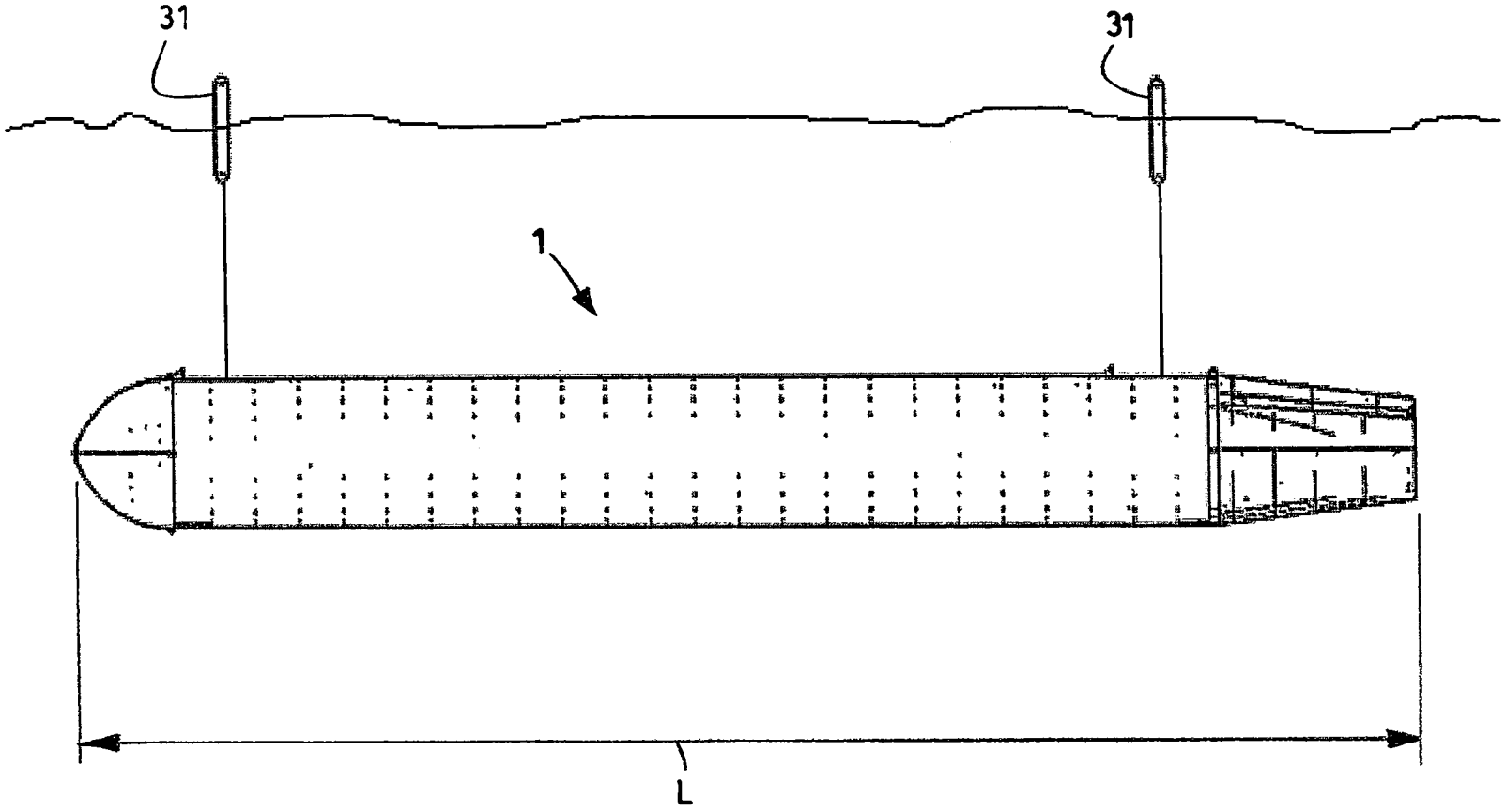
FIG. 7 shows a second side view of the underwater vehicle of FIG. 1 in an emergency condition.

For reasons of safety, two abandonment procedures can be adopted, for example, such not to entail the risk that the vehicle 1, going adrift, can reach the coast, with the risk of spills:

A1) detaching the underwater vehicle 1 from the craft towing it and letting it rest on the seabed;

A2) suspending it to the supporting buoys 31 (FIG. 7).

If, after effecting the procedure A1), the vehicle 1 rests on seabed at a depth greater than 500 meters, the times for recovering it may likely be extremely lengthy and, in order to reduce them, the vehicle 1 can be advantageously equipped with suitable signalers such as, for example, pingers, or other acoustic signaling devices.

In order to effect the emergency procedure A2), the vehicle 1 can carry the buoys 31 onboard; under normal conditions, the buoys 31 can be ballasted, for example, with water which, in an emergency situation, can be expelled allowing the buoys to rise to the surface. In emergency situations, the vehicle 1 preferably remains suspended to the buoys 31 at a significant depth equal or comparable to those of normal navigation, for example 50-80 meters, so as to avoid accidental impact with vessels or other floating objects, well away from the coast and without ever coming into contact with the atmospheric air. The buoys 31 on the surface guarantee visibility to other vessels and allow the vehicle 1 to be localized for subsequent recovery, as they are preferably equipped with signaling devices such as for example, stroboscopic lights, GPS antennas and a satellite communication system, for example of the Iridium or equivalent type, capable of sending the position of the vehicle 1 to an operating centre, pingers, sonars or other acoustic signaling devices.

The fact of being able to use ordinary tubes for underwater pipelines, for producing the containment tubes 9, in particular straight, allows a transportation vehicle to be constructed with relatively low costs, as semi-processed products can be exploited, such as tubes for pipelines, which are widely available on the market, relatively economical, extremely reliable and tested, and produced in large quantities according to qualitative standards which are generally considerably high. The storage of the fluid to be transported in a tube bundle, such as that of the tubes 9, allows the load to be divided into several containers, significantly limiting damages deriving from possible fires, explosions and spills in the case of faults or breakages.

Furthermore, the load can be distributed with considerable freedom and precision so as to optimize the stability of the vehicle. The main structure 11 has an extremely strong configuration and can also be produced at low costs with simple technologies, being mainly composed of metallic tubes, mostly straight, and transverse frames that can be obtained from flat metal plates or in any case only slightly bent, or from standard semi-processed products which are quite common and can be easily assembled by means of welding. The fact of also using the structural tubes 13 as ballast tanks for regulating the immersion or floating of the vehicle 1 contributes to reducing the costs and construction complexity of the latter. Its hollow tube-bundle structure makes the load bearing frame 11 extremely robust. The underwater vehicle 1 is very suitable for being used as a shuttle for transporting crude oil or natural gas from underwater extraction fields to the closest fixed refining or transportation plants on the mainland, especially, but not only, for exploiting wells with a relatively low extraction capacity or quite deep wells with wellheads situated, for example, at 2000-3000 meters in depth: in both cases, the connection, with the laying of oil-pipelines or gas-pipelines and other fixed infrastructures, could be only slightly or not at all economically convenient.

The embodiment examples previously described can undergo various modifications and variations, all included in the protection scope of the invention. Furthermore, all the details can be substituted by technically equivalent elements. The materials used, for example, as also the dimensions, can vary according to technical requirements. It should be understood that an expression of the type "A comprises B, C, D" or "A is composed of B, C, D" also comprises and describes the particular case in which "A consists of B, C, D". The examples and lists of possible variants of the present patent application should be considered as being non-exhaustive lists.

The invention claimed is:

1. A process for transporting an extraction fluid comprising the following operations:

a) hydraulically connecting a submerged underwater vehicle to a head of an extraction well;

b) transferring and storing the extraction fluid on the submerged underwater vehicle, subjecting said extraction fluid to one or more of the following treatment operations through one or more plants installed onboard the submerged underwater vehicle;

b.1) mechanical, electrical or chemical separation;

b.2) separation of one or more gases or one or more volatile fractions of present in the extraction fluid;

b.3) separation of one or more predetermined phases or substances from of the extraction fluid;

b.4) extraction and elimination of acid gases;

b.5) re-injection of at least one of a separated phase, gas, fraction, or substance into a geological formation;

c) transporting the extraction fluid subjected to the one or more of the treatment operations b.1-b.5, causing the submerged underwater vehicle to advance, d) preparing a first and a second removable module, each of which contains at least part of one or more motors, pumps, fluid, electric or electronic circuits to power or signal one or more of the plants installed onboard the submerged underwater vehicle to effect one or more of the treatment operations b.1)-b.5), or compressing or liquefying the extraction fluid in the submerged underwater vehicle, each removable module reversibly removable and reinstallable on the submerged underwater vehicle;

e) installing the first removable module on the submerged underwater vehicle;

f) removing the first removable module from the submerged underwater vehicle and installing the second removable module on the submerged vehicle;

g) effecting the transferring and storing b) and/or the transporting c) with the second removable module, while the first removable module is being subjected to at least one of maintenance and repair operations.

2. The process according to claim 1, comprising advancing the submerged underwater vehicle, by towing the submerged underwater vehicle by a ship or other craft.

3. The process according to claim 1, comprising transferring and storing the extraction fluid on the submerged underwater vehicle, by hydraulically connecting the submerged underwater vehicle to a submerged head of the extraction well.

4. The process according to claim 3, wherein, during the transferring the submerged underwater vehicle is hydraulically connected via a duct to the extraction well by a floating and submerged anchoring buoy.

5. The process according to claim 2, comprising:

detaching the submerged underwater vehicle from the ship or other craft; and suspending the submerged underwater vehicle to one or more floating buoys.

6. An underwater vehicle for transporting fluids, comprising: at least one container to contain the fluids to be transported, and one or more of the following plants:

a) a separation plant to separate at least one of a solid phase and a liquid phase from a gas with which the container is filled;

b) a plant to stabilize oil stored in the container and to separate one or more of a volatile fraction, a gas, a liquid, a solid and an undesired component dissolved in the oil from the oil;

c) a plant to separate an acid gas;

d) a plant to separate one or more predetermined phases or substances from the gas or other fluid to be transported;

e) a plant to generate power for possibly feeding other plants present on the underwater vehicle, f) a removable module containing at least a part of one or more motors, pumps, fluid, electric or electronic circuits to power or signal the plants installed onboard said underwater vehicle, wherein the removable module is reversibly removeable from and reinstallable on the underwater vehicle.

7. The underwater vehicle according to claim 6, further comprising one or more of the following plants:

a) a plant to compress the gases to be stored in the (9) container and/or to compress air to feed a circuit of compressed air destined for activating a series of motors, actuations and devices onboard the underwater vehicle;

b) a plant to reinject the fluids (gases or liquids) into a geological formation;

c) an emergency system;

d) a plant to signal, telemetry, localization or control of the underwater vehicle, or at least one container of the underwater vehicle.

8. The underwater vehicle according to claim 6, having an overall elongated form and comprising one or more containment tubes to contain the fluid to be transported and forming a bundle which prevalently extends longitudinally with respect to the underwater vehicle.

9. The underwater vehicle according to claim 6, comprising a load bearing frame to structurally strengthen the underwater vehicle itself and comprising a plurality of structural tubes which prevalently extend longitudinally with respect to the underwater vehicle.

10. The process according to claim 1, wherein the extraction fluid is at least one selected from the group consisting natural gas, oil and water.

11. The process according to claim 1, wherein the acid gas comprises at least one selected from the group consisting of carbon dioxide and hydrogen sulphide.

12. The underwater vehicle according to claim 1, wherein the separation plant is at least one of a mechanical separation plant, an electrical separation plant and a chemical separation plant.

* * * * *